US007142986B2

(12) United States Patent
Moran

(10) Patent No.: US 7,142,986 B2
(45) Date of Patent: Nov. 28, 2006

(54) SYSTEM FOR OPTIMIZING DRILLING IN REAL TIME

(75) Inventor: David P. Moran, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 37 days.

(21) Appl. No.: 11/048,516

(22) Filed: Feb. 1, 2005

(65) Prior Publication Data

US 2006/0173625 A1 Aug. 3, 2006

(51) Int. Cl.
*E21B 44/00* (2006.01)
*E21B 41/00* (2006.01)

(52) U.S. Cl. ..... 702/9

(58) Field of Classification Search ..... 702/6, 702/9, 12, 13; 703/10; 175/45
See application file for complete search history.

(56) References Cited

U.S. PATENT DOCUMENTS 4,794,534 A 12/1988 Millheim
5,220,963 A * 6/1993 Patton ..... 175/24
5,237,539 A * 8/1993 Selman ..... 367/69
5,730,234 A 3/1998 Putot
5,794,720 A 8/1998 Smith et al.
5,812,068 A 9/1998 Wisler et al.
6,002,985 A * 12/1999 Stephenson ..... 702/13
6,012,015 A 1/2000 Tubel
6,021,377 A 2/2000 Dubinsky et al.
6,022,985 A 2/2000 Authelin et al.
6,044,325 A 3/2000 Chakravarthy et al.
6,109,368 A 8/2000 Goldman et al.
6,131,673 A 10/2000 Goldman et al.
6,206,108 B1 3/2001 MacDonald et al.
6,233,524 B1 * 5/2001 Harrell et al. ..... 702/9
6,282,452 B1 * 8/2001 DeGuzman et al. ..... 700/32
6,346,595 B1 2/2002 O'Lenick, Jr.
6,374,926 B1 4/2002 Goldman et al.
6,408,953 B1 6/2002 Goldman et al.
6,424,919 B1 7/2002 Moran et al.
6,519,568 B1 * 2/2003 Harvey et al. ..... 705/1
6,560,565 B1 * 5/2003 Roy et al. ..... 702/188
6,609,067 B1 * 8/2003 Tare et al. ..... 702/9
6,612,382 B1 9/2003 King
6,826,483 B1 * 11/2004 Anderson et al. ..... 702/13
6,836,731 B1 * 12/2004 Whalley et al. ..... 702/13
7,031,840 B1 * 4/2006 Brett et al. ..... 702/9

(Continued)

FOREIGN PATENT DOCUMENTS

GB 2363860 1/2002

(Continued)

OTHER PUBLICATIONS

SPE/IADC 25727; Use of Drilling Parameters to Predict In-Situ Stress Bounds; G. Hareland, New Mexico Institute of Mining and Technology and L.L. Hoberock, Oklahoma State University (SPE members); paper prepared for presentation at the 1993 SPE/IADC Drilling Conference held in Amsterdam, The Netherlands, Feb. 22-25, 1993.

(Continued)

*Primary Examiner*—Donald McElheny, Jr.
(74) *Attorney, Agent, or Firm*—Osha Liang LLP

(57) ABSTRACT

A method for optimizing drilling parameters includes obtaining previously acquired data, querying a remote data store for current well data, determining optimized drilling parameters, and returning optimized parameters for a next segment to the remote data store. Determining optimized drilling parameters may include correlating the current well data to the previously acquired data, predicting drilling conditions for the next segment, and optimizing drilling parameters for the next segment.

27 Claims, 3 Drawing Sheets

U.S. PATENT DOCUMENTS

| | | | |
|---|---|---|---|
| 2002/0138240 | A1 | 9/2002 | Jelley et al. |
| 2003/0015351 | A1 | 1/2003 | Goldman et al. |
| 2003/0187582 | A1 | 10/2003 | Goldman et al. |
| 2004/0000430 | A1 | 1/2004 | King |
| 2004/0059554 | A1 | 3/2004 | Goldman et al. |
| 2004/0182606 | A1 | 9/2004 | Goldman et al. |
| 2004/0256152 | A1 | 12/2004 | Dashevskiy et al. |
| 2005/0001734 | A1 | 1/2005 | Miller, Jr. |
| 2005/0149306 | A1 | 7/2005 | King |

FOREIGN PATENT DOCUMENTS

| | | |
|---|---|---|
| GB | 2413403 | 10/2005 |
| WOPCT WO | 2004/113676 | 12/2004 |

OTHER PUBLICATIONS

Combined Search and Examination Report issued in Application No. GB0601822.0, dated Apr. 13, 2006 (7 pages).

* cited by examiner

SYSTEM FOR OPTIMIZING DRILLING IN REAL TIME

BACKGROUND OF INVENTION

1. Field of the Invention

The present invention is related generally to the field of rotary wellbore drilling. More specifically, the invention relates to methods for optimizing values of drilling variables, or parameters, in real time to improve or optimize drilling performance based on drilling objectives.

2. Background Art

Wellbore drilling, which is used, for example, in petroleum exploration and production, includes rotating a drill bit while applying axial force to the drill bit. The rotation and the axial force are typically provided by equipment at the surface that includes a drilling "rig." The rig includes various devices to lift, rotate, and control segments of drill pipe, which ultimately connect the drill bit to the equipment on the rig. The drill pipe provides a hydraulic passage through which drilling fluid is pumped. The drilling fluid discharges through selected-size orifices in the bit ("jets") for the purposes of cooling the drill bit and lifting rock cuttings out of the wellbore as it is being drilled.

The speed and economy with which a wellbore is drilled, as well as the quality of the hole drilled, depend on a number of factors. These factors include, among others, the mechanical properties of the rocks which are drilled, the diameter and type of the drill bit used, the flow rate of the drilling fluid, and the rotary speed and axial force applied to the drill bit. It is generally the case that for any particular mechanical properties of rocks, a rate at which the drill bit penetrates the rock ("ROP") corresponds to the amount of axial force on and the rotary speed of the drill bit. The rate at which the drill bit wears out is generally related to the ROP. Various methods have been developed to optimize various drilling parameters to achieve various desirable results.

Prior art methods for optimizing values for drilling parameters have focused on rock compressive strength. For example, U.S. Pat. No. 6,346,595, issued to Civolani, el al. ("the '595 patent"), and assigned to the assignee of the present invention, discloses a method of selecting a drill bit design parameter based on the compressive strength of the formation. The compressive strength of the formation may be directly measured by an indentation test performed on drill cuttings in the drilling fluid returns. The method may also be applied to determine the likely optimum drilling parameters such as hydraulic requirements, gauge protection, weight on bit ("WOB"), and the bit rotation rate. The '595 patent is hereby incorporated by reference in its entirety.

U.S. Pat. No. 6,424,919, issued to Moran, et al. ("the '919 patent"), and assigned to the assignee of the present invention, discloses a method of selecting a drill bit design parameter by inputting at least one property of a formation to be drilled into a trained Artificial Neural Network ("ANN"). The '919 patent also discloses that a trained ANN may be used to determine optimum drilling operating parameters for a selected drill bit design in a formation having particular properties. The ANN may be trained using data obtained from laboratory experimentation or from existing wells that have been drilled near the present well, such as an offset well. The '919 patent is hereby incorporated by reference in its entirety.

ANNs are a relatively new data processing mechanism. ANNs emulate the neuron interconnection architecture of the human brain to mimic the process of human thought. By using empirical pattern recognition, ANNs have been applied in many areas to provide sophisticated data processing solutions to complex and dynamic problems (i.e., classification, diagnosis, decision making, prediction, voice recognition, military target identification, to name a few).

Similar to the human brain's problem solving process, ANNs use information gained from previous experience and apply that information to new problems and/or situations. The ANN uses a "training experience" (i.e., the data set) to build a system of neural interconnects and weighted links between an input layer (i.e., independent variable), a hidden layer of neural interconnects, and an output layer (i.e., the dependant variables or the results). No existing model or known algorithmic relationship between these variables is required, but such relationships may be used to train the ANN. An initial determination for the output variables in the training exercise is compared with the actual values in a training data set. Differences are back-propagated through the ANN to adjust the weighting of the various neural interconnects, until the differences are reduced to the user's error specification. Due largely to the flexibility of the learning algorithm, non-linear dependencies between the input and output layers, can be "learned" from experience.

Several references disclose various methods for using ANNs to solve various drilling, production, and formation evaluation problems. These references include U.S. Pat. No. 6,044,325 issued to Chakravarthy, et al., U.S. Pat. No. 6,002,985 issued to Stephenson, et al., U.S. Pat. No. 6,021,377 issued to Dubinsky, et al., U.S. Pat. No. 5,730,234 issued to Putot, U.S. Pat. No. 6,012,015 issued to Tubel, and U.S. Pat. No. 5,812,068 issued to Wisler, et al.

Typically, vast amounts of data are collected before and during the drilling process. In the past, it has been impossible to account for all of the data when performing optimization techniques. What is needed, therefore, is a method for remotely performing drilling optimization methods based on the available data.

SUMMARY OF INVENTION

In one aspect, the invention relates to a method for optimizing drilling parameters that includes obtaining previously acquired data, querying a remote data store for current well data, determining optimized drilling parameters for a next segment and returning optimized parameters for a next segment to the remote data store. Determining the optimized drilling parameters may include correlating the current well data to the previously acquired data, predicting drilling conditions for the next segment, and optimizing drilling parameters for the next segment.

In another aspect, the invention relates to a method for optimizing drilling parameters in real-time that includes obtaining previously acquired data, querying a remote data store for current well data, determining current well formation properties, correlating the current well formation properties to formation properties determined from the previously acquired data, predicting formation properties for a next segment, optimizing the drilling parameters for the next segment, and returning the optimized drilling parameters to the remote data store.

In another aspect, the invention relates to a method of drilling that includes measuring current drilling parameters, uploading the current drilling parameters and the lagged data to a data store, querying the remote data store for optimized drilling parameters, and controlling the drilling according to the optimized drilling parameters.

Other aspects and advantages of the invention will be apparent from the following description and the appended claims.

DETAILED DESCRIPTION

Figure 1:
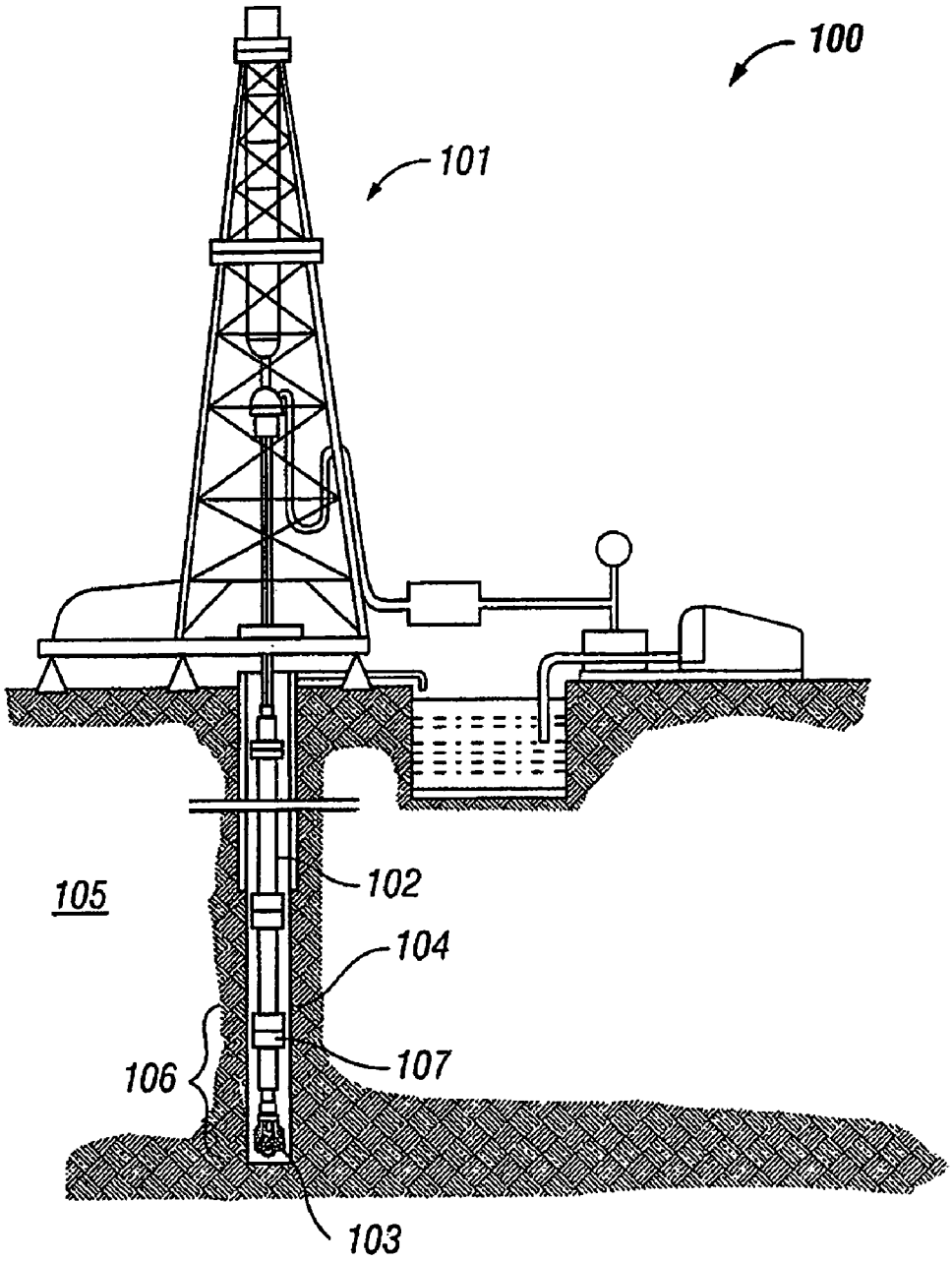
FIG. 1 (Prior Art)
FIG. 1 shows a typical drilling system.

In one or more embodiments, the present invention relates to a method for optimizing drilling parameters based on data queried from a remote data store. In some embodiments, the optimization method is performed in real-time.

The following section contains definitions of several specific terms used in this disclosure. These definitions are intended to clarify the meaning of the terms used herein. It is believed that the terms are used in a manner consistent with their ordinary meaning, but the definitions are nonetheless specified here for clarity.

The term "real-time" is defined in the McGraw-Hill Dictionary of Scientific and Technical Terms (6th ed., 2003) on page 1758. "Real-time" pertains to a data-processing system that controls an ongoing process and delivers its outputs (or controls its inputs) not later than the time when these are needed for effective control. In this disclosure, "in real-time" means that optimized drilling parameters for an upcoming segment of formation to be drilled are determined and returned to a data store at a time not later than when the drill bit drills that segment. The information is available when it is needed. This enables a driller or automated drilling system to control the drilling process in accordance with the optimized parameters. Thus, "real-time" is not intended to require that the process is "instantaneous."

The term "next segment" generally refers to a future portion of a formation ahead of the drill bit's current position that is to be drilled by the drill bit. A segment does not have a specified length. In one or more embodiments, the "next segment" comprises a change in formation lithology, porosity, compressive strength, shear strength, rock abrasiveness, the fluid in the pore spaces in the rock, or any other mechanical property of the rock and its contents that may require a change in drilling parameters to achieve an optimum situation. The next segment may extend to another change in formation lithology. In other embodiments, a segment may be broken into a selected size based on a size that is practical for use in optimizing drilling parameters.

The word "remote" is defined in The Chamber's Dictionary (9th ed., 2003) on page 1282. It is an adjective meaning "far removed in place, . . . widely separated." In relation to computers, The Chamber's Dictionary defines "remote" as "located separately from the main processor but having a communication link with it." In this disclosure, "remote" means at separate location (e.g., removed from the drilling site), but having a communication link (e.g., satellite, internet, etc.). For example, a "remote data store" may be at a different location from a drilling site. In one example, a "remote data store" is located at the location where the drilling parameters are optimized. In addition, a "remote data store" may be located at the drilling site, but remote from the drilling parameter optimization. In many embodiments, however, a "remote data store" is located remote from both the drilling site and the location where the drilling parameter optimization is performed.

The "current well" is the well for which an drilling parameter optimization method is being performed. The current well is set apart from an offset well or other types of wells that may be drilled in the same area. "Current well data" refers to data that related to the current well. The data relating to the current well may have been taken at any time.

In this disclosure, "previously acquired data" refers to at least (1) any data related to a well drilled in the same general area as the current well, (2) any data related to a well drilled in a geologically similar area, or (3) seismic or other survey data. "Previously acquired may be any data that may aid the predictive process described herein. Typically, "previously acquired data" is data obtained from the drilling of an "offset well" in the same area. Generally, an offset well has a smaller diameter than a typical production well. Offset wells are drilled to learn more information about the subterranean formations. In addition, data from previously or concurrently drilled other well bores in the same area may be used as previously acquired data. Finally, data from wells drilled in geologically similar areas may comprise part of the previously acquired data.

A "drilling parameter" is any parameter that affects the way in which the well is being drilled. For example, the WOB is an important parameter affecting the drilling well. Other drilling parameters include the torque-on-bit ("TOB"), the rotary speed of the drill bit ("RPM"), and mud flow rate. There are numerous other drilling parameters, as is known in the art, and the term is meant to include any such parameter.

The term "optimized drilling parameters" refers to values for drilling parameters that have been optimized for a given set of drilling priorities. "Optimized" does not necessarily mean the best possible drilling parameters because an optimization method may account for one or more drilling priorities. The optimized drilling parameters may be a result of these priorities, and may not represent the drilling parameters that will result in the most economical drilling or the longest bit life.

The present invention generally relates to methods for optimizing drilling parameters, in some cases in real-time. An optimization method may be performed by querying current well data from a remote data store. Once the method or methods are complete, the optimized drilling parameters may be uploaded to the data store for use. In some embodiments, the invention relates to methods for drilling using optimized drilling parameters in real-time.

The data that may be used in a method for optimizing drilling parameters may be collected during the drilling process. Such data may relate to current drilling parameters, formation properties, or any other data that may be collected during the drilling process. The following is a description of some of the data that may be collected, and how it related to the drilling an optimization processes.

FIG. 1 shows a typical drilling system 100. The drilling system 100 includes a rig 101 used to suspend a drill string 102 into a borehole 104. A drill bit 103 at the lower end of the drill string 102 is used to drill through Earth formations 105. Sensors and other drilling tools (e.g., drilling tool 107) may be included in a bottom hole assembly 106 ("BHA") near the bottom of the drill string 102. The drilling system 100 shown in FIG. 1 is a land-based drilling system. Other drilling systems, such as deep water drilling systems, are located on floating platforms. The difference is not germane to the present invention, and no distinction is made.

While drilling, it is desirable to gather as much data about the drilling process and about the formations through which the borehole 104 penetrates. The following description provides examples of the types of sensors that are used and the data that are collected. It is noted that in practice, it is impractical to use all of the sensors described below due to space and time constraints. In addition, the following description is not exhaustive. Other types of sensors are known in the art that may be used in connection a drilling process, and the invention is not limited to the examples provided herein.

The first type of data that are collected may be classified as near instantaneous measurements, often called "rig sensed data" because it is sensed on the rig. These include the WOB and the TOB, as measured at the surface. Other rig sensed data include the RPM, the casing pressure, the depth of the drill bit, and the drill bit type. In addition, measurements of the drilling fluid ("mud") are also taken at the surface. For example, the initial mud condition, the mud flow rate, and the pumping pressure, among others. All of these data may be collected on the rig 101 at the surface, and they represent the drilling conditions at the time the data are available.

Other measurements are taken while drilling by instruments and sensors in the BHA 106. These measurements and the resulting data are typically provided by an oilfield services vendor that specializes in making downhole measurements while drilling. The invention, however, is not limited by the party that makes the measurements or provides the data.

As described with reference to FIG. 1, a drill string 102 typically includes a BHA 106 that includes a drill bit 103 and a number of downhole tools (e.g., tool 107 in FIG. 1). Downhole tools may include various sensors for measuring the properties related to the formation and its contents, as well as properties related to the borehole conditions and the drill bit. In general, "logging-while-drilling" ("LWD") refers to measurements related to the formation and its contents. "Measurement-while-drilling" ("MWD"), on the other hand, refers to measurements related to the borehole and the drill bit. The distinction is not germane to the present invention, and any reference to one should not be interpreted to exclude the other.

LWD sensors located in a BHA 106 may include, for example, one or more of a gamma ray tool, a resistivity tool, an NMR tool, a sonic tool, a formation sampling tool, a neutron tool, and electrical tools. Such tools are used to measure properties of the formation and its contents, such as, the formation porosity, density, lithology, dielectric constant, formation layer interfaces, as well as the type, pressure, and permeability of the fluid in the formation.

One or more MWD sensors may also be located in a BHA 106. MWD sensors may measure the loads acting on the drill string, such a WOB, TOB, and bending moments. It is also desirable to measure the axial, lateral, and torsional vibrations in the drill string. Other MWD sensors may measure the azimuth and inclination of the drill bit, the temperature and pressure of the fluids in the borehole, as well as properties of the drill bit such as bearing temperature and grease pressure.

The data collected by LWD/MWD tools is often relayed to the surface before being used. In some cases, the data is simply stored in a memory in the tool and retrieved when the tool it brought back to the surface. In other cases, LWD/MWD data may be transmitted to the surface using known telemetry methods.

Telemetry between the BHA and the surface, such as mud-pulse telemetry, is typically slow and only enables the transmission of selected information. Because of the slow telemetry rate, the data from LWD/MWD may not be available at the surface for several minutes after the data have been collected. In addition, the sensors in a typical BHA 106 are located behind the drill bit, in some cases by as much as fifty feet. Thus, the data received at the surface may be slightly delayed due to the telemetry rate that the position of the sensors in the BHA.

Other measurements are made based on lagged events. For example, drill cuttings in the return mud are typically analyzed to gain more information about the formation that has been drilled. During the drilling process, the drill cuttings are transported to the surface in the mud flow in through the annulus between the drill string 102 and the borehole 104. In a deep well, for example, the drill bit 103 may drill an additional 50 to 100 feet while a particular fragment of drill cuttings travels to the surface. Thus, the drill bit continues to advance an additional distance, while the drilled cuttings from the depth position of interest are transported to the surface in the mud circulation system. The data is lagged by at least the time to circulate the cuttings to surface.

Analysis of the drill cuttings and the return mud provides additional information about the formation and its contents. For example, the formation lithology, compressive strength, shear strength, abrasiveness, and conductivity may be measured. Measurements of the return mud temperature, density, and gas content may also yield data related to the formation and its contents.

Figure 2:
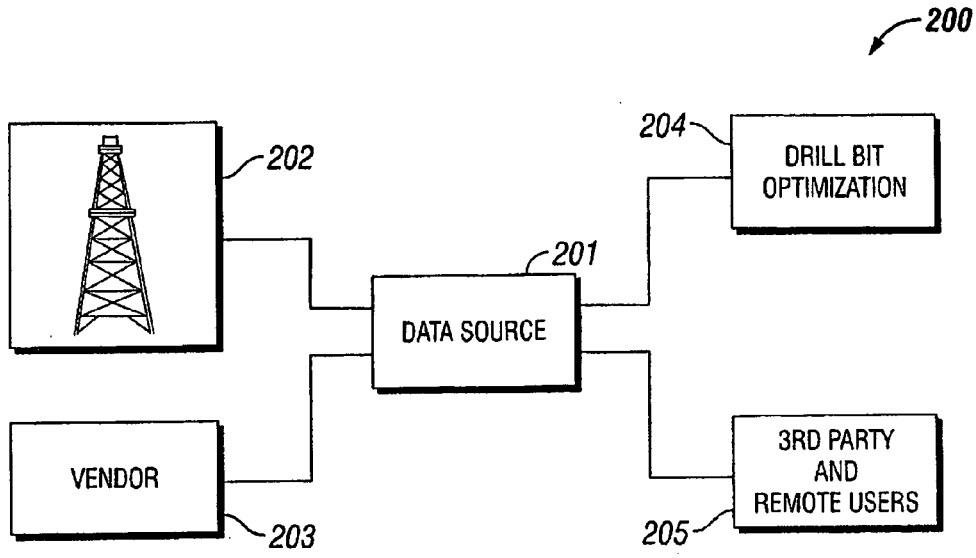
FIG. 2 shows a schematic of communication connections relating to a drilling process.

FIG. 2 shows a schematic of drilling communications system 200. The drilling system (e.g., drilling system 100 in FIG. 1), including the drilling rig and other equipment at the drilling site 202, is connected to a remote data store 201. As data is collected at the drilling site 202, the data is transmitted to the data store 201.

The remote data store 201 may be any database for storing data. For example, any commercially available database may be used. In addition, a database may be developed for the particular purpose of storing drilling data without departing from the scope of the invention. In one embodiment, the remote data store uses a WITSML (Wellsite Information Transfer Standard) data transfer standard. Other transfer standards may also be used without departing from the scope of the invention.

The drilling site 202 may be connected to the data store 201 via an internet connection. Such a connection enables the data store 201 to be in a location remote from the drilling site 202. The data store 201 is preferably located on a secure server to prevent unauthorized access. Other types of communication connections may be used without departing from the scope of the invention.

Other party connections to the data store 201 may include an oilfield services vendor(s) 203, a drilling optimization service 204, and third party and remote users 205. In some embodiments, each of the different parties (202, 203, 204, 205) that have access to the data store 201 are in different locations. In practice, oilfield service vendors 203 are typically located at the drilling site 202, but they are shown separately because vendors 203 represent a separate party having access to the data store 201. In addition, the invention does not preclude a vendor 203 from transmitting the LWD/MWD measurement data to a separate site for analysis before the data are uploaded to the data store 201.

In addition to having a data store 201 located on a secure server, in some embodiments, each of the parties connected to the data store 201 has access to view and update only specific portions of the data in the data store 201. For example, a vendor 203 may be restricted such that they cannot upload data related to drill cutting analysis, a measurement which is typically not performed by the vendor.

As measurement data becomes available, it may be uploaded to the data store 201. The data may be correlated to the particular position in the wellbore to which the data relate, a particular time stamp when the measurement was taken, or both. The normal rig sensed data (e.g., WOB, TOB, RPM, etc.) will generally relate to the drill bit position in the wellbore that is presently being drilled. As this data is uploaded to the data store 201, it will typically be correlated to the position of the drill bit when the data was recorded or measured.

Vendor data (e.g., data from LWD/MWD instruments), as discussed above, may be slightly delayed. Because of the position of the sensors relative to the drill bit and the delay in the telemetry process, vendor data may not relate to the current position of the drill bit when the data become available. Still, the delayed data will typically be correlated to a specific position in the wellbore when it was measured and then is uploaded to the data store 201. It is noted that the particular wellbore position to which vendor data are correlated may be many feet behind the current drill bit position when the data become available.

In some embodiments, the vendor data may be used to verify or update rig sensed data that has been previously recorded. For example, one type of MWD sensor that is often included in an BHA is a load cell or a load sensor. Such sensors measure the loads, such as WOB and TOB, that are acting on the drill string near the bottom of the borehole. Because data from near the drill bit will more closely represent the actual drilling conditions, the vendor data may be used to update or verify similar measurements made on the rig. One possible cause for a discrepancy in such data is that the drill string may encounter friction against the borehole wall. When this occurs, the WOB and TOB measured at the surface will tend to be higher that the actual WOB and TOB experienced at the drill bit.

The process of drilling a well typically includes several "trips" of the drill string. A "trip" is when the entire drill string is removed from the well to, for example, replace the drill bit or other equipment in the BHA. When the drill string is tripped, it is common practice to lower one or more "wireline" tools into the well to investigate the formations that have already been drilled. Typically wireline tool measurements are performed by an oilfield services vendor.

Wireline tools enable the use of sensors and instruments that may not have been included in the BHA. In addition, the wire that is used to lower the tool into the well may be used for data communications at much faster rates that are possible with telemetry methods used while drilling. Data obtained through the use of wireline tools may be uploaded to the data store so that the data may be used in future optimization methods performed for the current well, once drilling recommences.

As was mentioned above, it is often the case that some of the LWD/MWD data that is collected may not be transmitted to the surface due to constraints in the telemetry system. Nonetheless, it is common practice to store the data in a memory in the downhole tool. When the BHA is removed from the well during a trip of the drill string, a surface computer may be connected to the BHA sensors and instruments to obtain all of the data that was gathered. As with wireline data, this newly collected LWD/MWD data may be uploaded to the data store for use in the continuous or future optimization methods for the current well.

Similar to vendor data, data from lagged events may also be correlated to the position in the wellbore to which the data relate. Because the data is lagged, the correlated position will be a position many feet above the current position of the drill bit when the data becomes available and is uploaded to the data store 201. For example, data gained through the analysis of drill cuttings may be correlated to the position in the wellbore where the cuttings were produced. By the time such data becomes available, the drill bit may have drilled many additional feet.

As with certain types of vendor data, some lagged data may be used to update or verify previously obtained data. For example, analysis of drill cuttings may yield data related to the porosity or lithology of the formation. Such data may be used to update or verify vendor data that is related to the same properties. In addition, some types of downhole measurements are dependent of two or more properties. Narrowing the possible values for porosity, for example, may yield better results for other formation properties. The newly available data, as well as data updated from lagged events, may then be used in future optimization methods.

Figure 3:
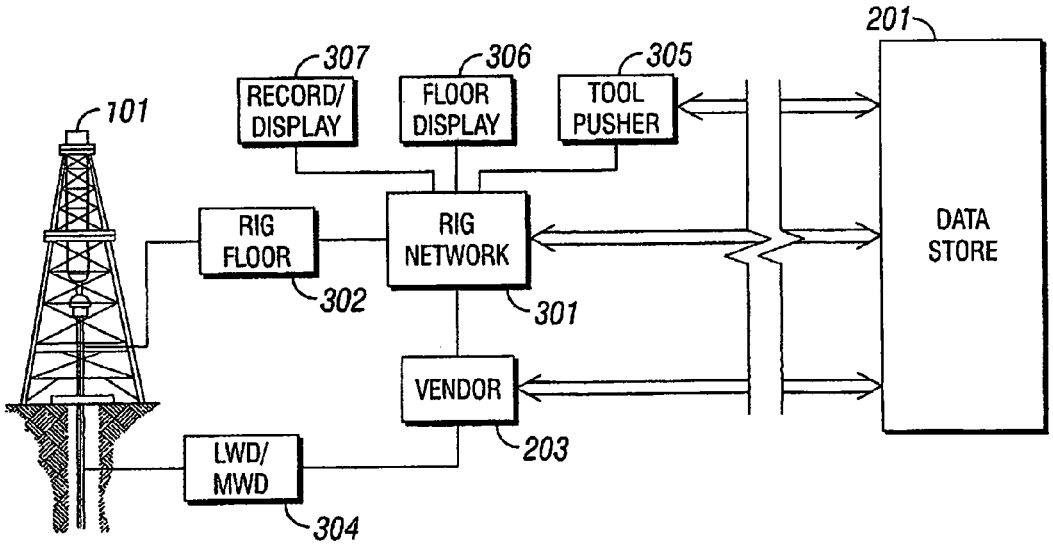
FIG. 3 shows a schematic of a rig communications network.

FIG. 3 shows a schematic of a one example of communications at a drilling site. A rig network 301 is generally used to connect the components on the rig 101 or at the rig site so that communication is possible. For example, most of the rig sensed data and lagged data are measured at the rig floor, represented generally at 302. The data collected at the rig floor 302 may be transmitted, through the rig network 301, to locations where the data may be useful. For example, the data may be recorded on chart recorded and printers or plotters, represented generally at 307. The data may be transmitted to a rig floor display, shown generally at 306, or to a display for the tool pusher (Rig Manager) of company man (Operator Representative), shown generally at 305.

In addition, a vendor, shown generally at 203 may collect data, such as LWD/MWD data and wireline data, from downhole tools, shown generally at 304. Such data may then be communicated, through the rig network 301, to those locations where the data may be useful or needed.

In the example shown in FIG. 3, the rig network 301 is connected to a remote data store 201. The remote data store 201 may be located apart from the drilling site. For example, the rig network may be connected to the data store 201 through a secure internet connection. In addition to the rig network 301, other users may also be connected to the data store 201. For example, as shown in FIG. 3, the tool pusher or company man 305 may be connected to the data store so that data may be directly queried from the data store 201. Also, a vendor 203 may be connected to the data store 201 so that vendor data may be uploaded to the data store 201 as soon as it becomes available.

The schematic in FIG. 3 is shown only as an example. Other configurations may be used without departing from the scope of the invention.

Figure 4:
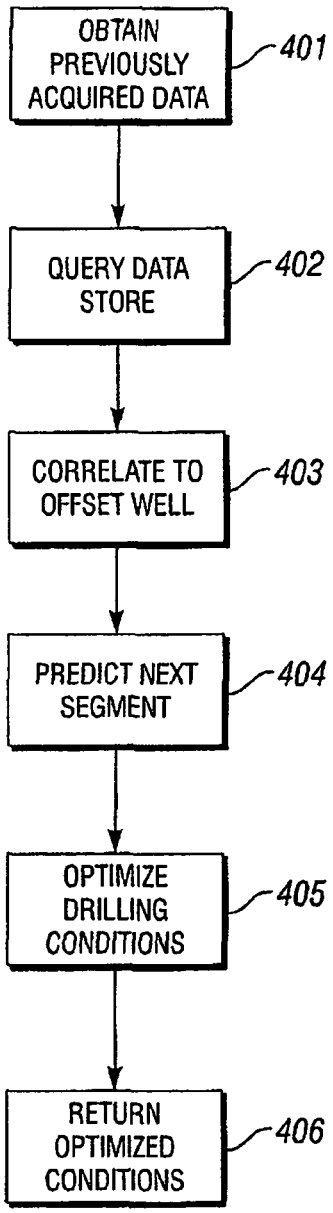
FIG. 4 shows a method in accordance with at least one embodiment of the invention.

FIG. 4 shows a method in accordance with the invention for optimizing drilling parameters in real time. In one or more embodiments, the method is performed by a drilling optimization service. One such service, called DBOS™, is offered by Smith International, Inc., the assignee of the entire right in the present application. A method for optimizing drilling parameters may be performed at a location that is remote from the drilling site. A remote data store may also be at any location. It is within the scope of the invention for a data store to be located at the drilling site or at the same location where the method for optimizing drilling parameters is being performed. In some embodiments, the data store is remote from at least one, if not both, of the drilling site and the location of the drilling parameter optimization.

The method includes obtaining previously acquired data, at step 401. In some embodiments, the previously acquired data is known before the current well is drilled. Thus, the data may be provided to a drilling optimization service before the current well is drilled. In other embodiments, the previously acquired data may be stored in the data store, and the previously acquired data may be queried from the data store—either separately or together with the current well data.

The method includes querying the data store to get the current well data, at step 402. In some embodiments, querying the current well data includes obtaining all of the data that is available for the current well. In other embodiments, querying the current well data include obtaining only certain of the data that are specifically desired.

The current well data that is queried may include any data related to the current well, the formations through which the current well passes and their contents, as well as data related to the drill bit and other drilling conditions. For example, current well data may include the type, design, and size of the drill bit that is being used to drill the well. Current well data may also include rig sensed data, LWD/MWD data, and any lagged data that has been obtained.

It is noted that the current well data may not include data related to all of the properties and sensors mentioned in this disclosure. In practice, the instruments and sensors used in connection with drilling a well are selected based on a number of different factors. It is generally impracticable to use all of the sensors mentioned in this disclosure while drilling a well. In addition, even though certain instruments may be included in a BHA, for example, the data may not be available. This may occur because certain other data are deemed more important, and the available telemetry bandwidth is used to transmit only selected data.

It is also noted that a particular method for optimizing drill bit parameters may be performed multiple times during the drilling of a well. One particular instance of querying the data store for the current well data may yield updated or new data for a particular part of the formation that has already been drilled. This will enable the current optimization method to account for previous drilling conditions, as will be explained, even though those conditions were not previously known.

FIG. 4 shows three separate steps for correlating the current well data to the previously acquired data (at 403), predicting the next segment (at 404), and optimizing drilling parameters (405). Each of these will be described separately, but it is noted that in some embodiments, these steps may be performed simultaneously. For example, an ANN, as will be described, may be trained to optimize the drilling parameters using only previously acquired data and current well data as inputs. In this regard, the "steps" may be performed simultaneously by a computer with an installed trained ANN. Although this description and FIG. 4 include three separate "steps," the invention is not intended to be so limited. This format for the description is used only for ease of understanding. Those having skill in the art will appreciate that a computer may be programmed to perform multiple "steps" at one time.

The method may next include correlating the current well data to previously acquired data, at step 403. There is, in general, a correspondence between the subterranean formations traversed by one well and that of a nearby well. A comparison or correlation of the current well data to that of an offset well (or other well drilled in the same area or a geographically similar area) may enable a determination of the position of the drill bit relative to the various structures and formations. In addition, the data from nearby wells, or wells in geologically similar areas, may provide information about the characteristics and properties of the formation rock.

A correlation of current well data to previously acquired data may include a determination of the formation properties of the current well. The current well formation properties may then be compared and correlated to the known formation properties from an offset well (or other well). It is noted that these properties may be determined from analysis of the previously acquired data. By identifying the relative position in the offset well that corresponds to the properties of the current well at a particular position, the relative position in the current well with respect to formation boundaries and structures may be determined. It is noted that formation boundaries and other structures often have changing elevations. A formation boundary in one well may not occur at the same elevation as the same boundary in a nearby well. Thus, the correlation is performed to determine the relative position in the current well with respect to the boundaries and structures.

In some embodiments, the current well data is analyzed by other parties, such as third party users and vendors. The other parties may determine the formation properties in the current well, and that information may be uploaded to the data store. In this case, the optimization method need not specifically include determining the formation properties.

In some embodiments, the formation properties are not specifically determined at all. Instead, the raw measurement data from the current well may be compared to similar data from the previously acquired data. In this aspect, the relative position in the current well may be determined without specifically determining the formation properties of the current well.

In some embodiments, a fitting algorithm may be used to correlate the current well data to the previously acquired data. Fitting algorithms are known in the art. In addition, a fitting algorithm may include using an error function. An error function, as is known in the art, will enable finding the correlation that provides the smallest differences between the current well data and the previously acquired data.

In some embodiments, correlating the current well data to previously acquired data may be performed by a trained ANN. For example, determining the physical properties of an Earth formation using an ANN is described in the '919 patent (U.S. Pat. No. 6,424,919, described in the Background section, and incorporated by reference in its entirety). In general, training an ANN includes providing the ANN with a training data set. A training data set includes known input variables and known output variables that correspond to the input variables. The ANN then builds a series of neural interconnects and weighted links between the input variables and the output variables. Using this training experience, an ANN may then predict unknown output variables based on a set of input variables.

To train the ANN to determine formation properties, a training data set may include known input variables (representing well data, e.g., previously acquired data) and known output variables (representing the formation properties corresponding to the well data). After training, a ANN may be used to determine unknown formation properties based on measured well data. For example, raw current well data may be input to a computer with a trained ANN. Then, using the trained ANN and the current well data, the computer may output estimations of the formation properties.

Further, it is noted that although correlating current well data to previously acquired data may be done entirely by a computer, in certain embodiments, it may also include human input. For example, a human may check a particular correlation to be sure that a computer (possibly including an ANN) has not made an error that would be immediately identifiable to a person skilled in the art. If such an error is made, a optimization method operator may intervene to correct the error.

The method may next include predicting the drilling conditions for the next segment, at step 404. Based on the correlation of the current well data to the previously acquired data, a prediction is made about the nature of the formation to be drilled—that is, the formation in front of the drill bit. In some cases, this may include a prediction that the characteristics of the formation to be drilled are not changing. In other cases, the prediction may include a change in formation or rock characteristics for the next segment.

Possible changes in formation or rock characteristics include changes in the rock compressive strength or shear strength, or changes on other rock mechanical properties. These changes may result from crossing a formation layer boundary. For example, a drill bit that is currently drilling through sandstone may be predicted to cross a formation boundary in the next segment so that the drill bit will then be drilling shale or limestone. When the drill bit crosses a formation layer boundary, the new type of rock will generally have different mechanical properties requiring different drilling parameters to be used for an optimal condition.

In some embodiments, predicting the formation properties for the next segment includes predicting the formation properties for the remainder of the planned well (i.e., to the planned depth). The prediction of the formation properties of the next segment are used to then predict the formation properties for the following segment. In this manner, the formation properties for the remainder of the run may be predicted.

In some embodiments, the previous prediction of formation properties for the next segment, or for any previously optimized segment, may be updated based on current well data that was not available when the previous prediction was made. For example, a prediction about the formation properties for the next segment may be made without the benefit of lagged data or of data obtained using a wireline tool. In a subsequent performance of the method, such data may be available for previously drilled sections of the well. The newly available data may be used to update previous optimizations so that a better optimization for the next segment may be obtained.

It is noted that the prediction of the formation properties for the next segment may be verified by subsequent LWD/MWD data, or other vendor data. When subsequent measurements confirm the prediction, this increases the confidence in the optimization result. First, it increases the confidence in the correlation of the current well data to the previously acquired well. Second, it provides confidence that the prediction of the formation properties for the next segment is also accurate. In the event that the measurements do not confirm the prediction, the optimization method may be performed again, or human intervention may be required. In addition, non-confirming subsequent measurements may indicate an anomalous downhole situation that may require special action by the driller.

Predicting the formation properties may be done using a trained ANN. In such embodiments, the ANN may be trained using a training data set that includes the previously acquired data and the correlation of well data to offset well data as the inputs and known next segment formation properties as the outputs. Using the training data set, the ANN may build a series of neural interconnects and weighted links between the input variables and the output variables. Using this training experience, an ANN may then predict unknown formation properties for the next segment based on inputs of previously acquired data and the correlation of the current well data to the previously acquired data.

Next, the method may include optimizing drilling parameters, at step 405. The optimum drilling parameters are determined for drilling the next segment, based on the drill bit being used and the predicted formation properties of the next segment. Once determined, the optimum drilling parameters may be uploaded to the data store so that they are available to rig personnel and other parties needing the information. In some embodiments, as will be explained, an automated drilling control system queries the data store for the optimum drilling parameters and controls the drilling process accordingly.

The optimized parameters are recommended drilling parameters for drilling the next segment. Such parameters may include WOB, TOB, RPM, mud flow rate, mud density, and any other drilling parameter that is controlled by a driller. In some embodiments, the drilling parameters are optimized for the current drill bit. In other embodiments, the optimized parameters may include a recommendation to change the drill bit for the next segment. A drastic change in formation type may require a different type of drill bit for the best optimization of the drilling parameters. This process is also addressed in the '919 patent.

Determining the optimized parameters may be based on one or more drilling priorities. For example, in one embodiment, the drilling parameters are optimized to drill the well in the most economical way. This may include balancing the life of the bit with maximizing the ROP. In one particular embodiment, this includes determining an ellipse representing acceptable values for bit life and ROP, and the drilling parameters are selected so that the bit life and ROP fall in the ellipse.

Other examples of priorities that may be used for optimizing drilling parameters include reducing vibration, as well as directional plan and target considerations. Vibration may be very harmful to a drill bit. In extreme cases, vibration may cause premature catastrophic failure of the drill bit. If vibration is detected or predicted, the drilling parameters may be optimized to reduce the vibration, even though the vibration-optimized parameters may not produce the most economically drilled well or segment. Also, if the directional plan calls for a specified build angle to reach a particular underground target, such a priority may take precedence over economic or ROP considerations. In such a case, the drilling parameters may be optimized to maintain the desired well trajectory.

It may be possible that LWD/MWD measurements reveal that the planned target may not be in the location where it was thought to be. In such a case, the target may be revised during the drilling process. In such a case, the optimization method may devise a new optimal directional plan and account for the new direction plan in the drilling priorities. In other cases, a new directional plan may be uploaded to the data store for use in the optimization method.

In some embodiments, optimizing drilling parameters includes predicting a "dulling off" of the drill bit. The amount of drill bit dulling that has already occurred will affect the way the drill bit drills the next segment, and the amount of dulling may have an affect on the optimized parameters. The amount of drill bit dulling that has occurred may be estimated based on current well data for those portions of the formation that have already been drilled, as well as data related to such things as WOB, TOB, RPM, mud flowrate, drilling pressure, and data related to measurements of the drill bit properties while drilling. In addition, the optimization may include predicting the level of drill bit dulling that will occur while drilling the next segment. In addition, after tripping the drill string, the amount of dulling may be specified or reset following an inspection or replacement of the drill bit.

Further, in some embodiments, optimizing drilling parameters for the remainder of a bit run may include predicting the dulling off that will occur if the segments to be drilled are drilled using the optimized parameters. This may include optimizing the drilling parameters for a future segment based on the dulling off of the drill bit that is predicted to occur in drilling to that segment. In some embodiments, the prediction of dulling off is revised based on drilling parameters that are actually used, in the event that the actual drilling parameters for a particular segment vary from the optimized values for that segment.

In addition to predicting the dulling that has occurred, and optimization method may include predicting the hours of bit life remaining. This may be accomplished by predicting how the drill bit will wear while drilling the next segment, and other future segments, using the optimized drilling parameters. This may also enable the determination of the depth at which the drill bit will wear out or fail, if that may occur before the drill bit reached the target or planned depth.

In some embodiments, a method for optimizing drilling parameters include predicting optimized parameters for the entire run of the drill bit to the planned depth. The method may include consideration of predicted formation properties for the entire run based on correlations of the current well data to previously acquired data.

In still further embodiment, the method may include consideration of lagged or delayed data that was not previously available. The estimation of drill bit dulling and the optimization of drilling parameters may be re-performed based on the newly available data.

Optimizing the drilling parameters 405 may include the use of a trained ANN. In such embodiments, the ANN may be trained using a training data set that includes the known formation properties, drill bit properties, and drilling priorities as the inputs and known optimum parameters as the training outputs. Using the training data set, the ANN may build a series of neural interconnects and weighted links between the input variables and the output variables. Using this training experience, an ANN may then predict the optimized drilling properties for the next segment based on inputs of the predicted formation properties for the next segment of the current well, the drill bit properties, and the current well drilling priorities.

As was mentioned above, a computer having a trained ANN installed thereon may be used to perform the correlation to previously acquired data, prediction of next segment properties, and drilling condition optimization. These "steps" may be performed by a computer, using one or more ANNs to determine the optimized drilling parameters. The current well data and the previously acquired data may be input into the computer or ANN, and the outputs would be the optimized drilling parameters for the next segment.

In some embodiments, the ANN, or separate ANNs, may be trained to perform individual steps. In at least one embodiment, on ANN is trained to make the neural interconnections and weighted links for the entire optimizing operation.

Finally, the method may include uploading the optimized parameters to the data store, at step 406. Once a particular optimization method is performed, the optimized parameters may be uploaded to the data store so that the optimized parameters are available to personnel, computers, and "smart" tools with processor capabilities at the drilling site. In some embodiments, the optimized parameters include recommended changes to be made immediately. In other embodiments, the optimized parameters include a position or depth at which the optimized parameters should be implemented. This may represent, for example, a prediction that the drill bit will encounter a formation boundary at a specific position, and the parameters are optimized for the segment of the well to be drilled at or beyond the formation boundary.

In some embodiments, the uploaded data represents the optimized drilling parameters for the remainder of the run to the planned depth, or some segment thereof. In some other embodiments, the uploaded parameters may be revised from a previous optimization to planned depth based on newly available data.

The method may include using an automated drilling system to control the drilling process. In that case, the automated drilling system may query the data store for the optimized drilling parameters and control the drilling accordingly. A typical automated drilling system uses servos and other actuators to operate conventional drilling control. It is usually done this way so that a driller may take over the process by disengaging the automated system and operating the control in the conventional way. However, other automated systems, for example computer control of the entire process, may be used without departing from the scope of the present invention.

Figure 5:
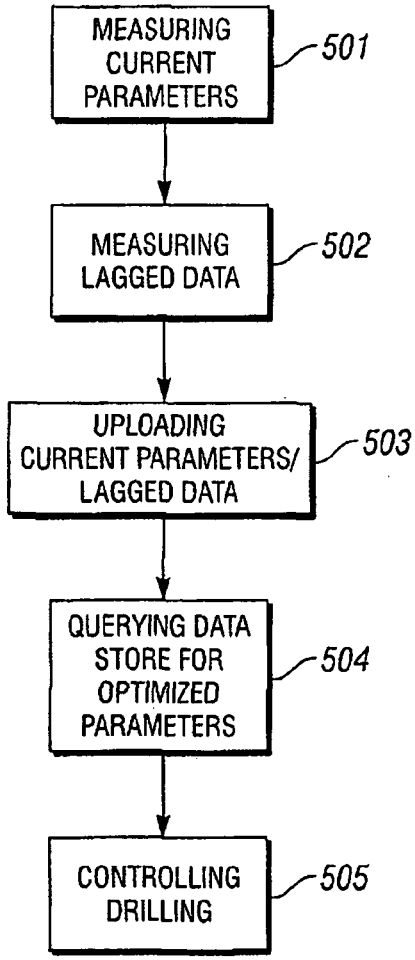
FIG. 5 shows a method in accordance with at least one embodiment of the invention.

FIG. 5 shows a method of drilling, in accordance with one aspect of the invention. The method first includes measuring current drilling parameters, at 501. This is the rig-sensed data, including WOB, TOB, RPM, etc. In some embodiments, the method also includes measuring the lagged data, such a return mud analysis, at 502. This step may not be included in all embodiments.

The method includes uploading the current parameters and the lagged data to a remote data store, at 503. The data may then be queried from the remote data store for analysis by a drilling optimization service. The method may also include querying the remote data store for a set of optimized drilling parameters for the next segment, at 504. In some embodiments, the optimized parameters are returned to the data store by a drilling optimization service. In some cases, querying the remote data store for the optimized parameters include querying the optimized parameters for the remainder of the run to the target depth.

The method may then include controlling the drilling in accordance with the optimized drilling parameters, at 505. In some embodiments, this is performed by a driller. In other embodiments, the drilling is performed by an automated drilling system, and controlling the drilling in accordance with the optimized parameters is performed by the automated drilling system.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for optimizing drilling parameters, comprising:

obtaining previously acquired data;

querying a remote data store for current well data;

determining optimized drilling parameters for a next segment; and returning the optimized parameters for the next segment to the remote data store.

2. The method of claim 1, wherein the determining the optimized drilling parameters comprises:

correlating the current well data to the previously acquired data;

predicting drilling conditions for the next segment; and optimizing drilling parameters for the next segment.

3. The method of claim 2, further comprising:

predicting drilling conditions to a planned depth; and optimizing drilling parameters to the planned depth.

4. The method of claim 3, wherein the optimizing the drilling parameters to the planned depth comprises updating a previous optimization using at least one selected from the group consisting of updated data and newly available data.

5. The method of claim 2, wherein the optimizing drilling parameters for the next segment is performed with the use of a trained artificial neural network.

6. The method of claim 5, wherein the correlating data is performed with a second artificial neural network, and the predicting the drilling conditions is performed with a third artificial neural network.

7. The method of claim 2, wherein the correlating the current well data comprises:

obtaining current well formation properties; and correlating the formation properties to offset well properties.

8. The method of claim 7, wherein the obtaining current well formation properties comprises at least one selected from the group consisting of determining the current well formation properties based on the current well data and querying the data store for the current well formation properties.

9. The method of claim 2, wherein the correlating the current well data to the previously acquired data comprises using a fitting algorithm.

10. The method of claim 9, wherein the using the fitting algorithm comprises minimizing an error function.

11. The method of claim 2, wherein the optimizing the drilling parameters comprises estimating a dulling off of the drill bit that has occurred.

12. The method of claim 11, wherein the optimizing the drilling parameters comprises predicting a dulling off of the drill bit that will occur while drilling the next segment.

13. The method of claim 12, wherein the optimizing the drilling parameters comprises predicting a dulling off of the drill bit that will occur while drilling to a planned depth.

14. The method of claim 13, further comprising predicting a number of hours of remaining bit life.

15. The method of claim 2, wherein the optimizing the drilling parameters is performed based on a set of drilling priorities.

16. The method of claim 15, wherein the set of drilling priorities includes at least one selected from the group consisting of a well path, a vibration problem, a drilling economics, a bit life, and a rate of penetration.

17. The method of claim 1, wherein the determining the optimized parameters is performed with an artificial neural network.

18. The method of claim 1, wherein the querying the remote data store, the determining the optimized drilling parameters, and the returning the optimized parameters are performed in real-time.

19. The method of claim 1, wherein the drilling parameters comprise at least one selected from the group consisting of weight on bit, torque on bit, rotary speed, and mud flowrate.

20. The method of claim 1, wherein the previously acquired data comprise data measured from an offset well.

21. The method of claim 1, wherein the previously acquired data comprise data from at least one selected from the group consisting of data from a nearby previously drilled well and data from a well drilled in a geologically similar area.

22. The method of claim 1, wherein the remote data store uses a WITSML data transfer standard.

23. The method of claim 1, further comprising:

communicating the optimized drilling parameters to an automated drilling system at a drilling site; and controlling the drilling parameters using the automated drilling system.

24. A method for optimizing drilling parameters in real-time, comprising:

obtaining previously acquired data;

querying a remote data store for current well data;

determining current well formation properties;

correlating the current well formation properties to formation properties determined from the previously acquired data;

predicting formation properties for a next segment;

optimizing the drilling parameters for the next segment; and returning the optimized drilling parameters to the remote data store.

25. A method of drilling, comprising:

measuring current drilling parameters;

uploading the current drilling parameters to a data store;

querying the remote data store for optimized drilling parameters; and controlling the drilling according to the optimized drilling parameters.

26. The method of claim 25, further comprising:

measuring lagged data; and uploading the lagged data to the data store.

27. The method of claim 26, further comprising repeating querying the remote data store for updated optimized drilling parameters.

* * * * *